US010845745B2

(12) United States Patent
Akiyama

(10) Patent No.: US 10,845,745 B2
(45) Date of Patent: Nov. 24, 2020

(54) PAPER FEEDING DEVICE

(71) Applicant: TOSHIBA TEC KABUSHIKI KAISHA, Tokyo (JP)

(72) Inventor: Koichi Akiyama, Kanagawa (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 162 days.

(21) Appl. No.: 16/032,372

(22) Filed: Jul. 11, 2018

(65) Prior Publication Data

US 2019/0121275 A1 Apr. 25, 2019

(30) Foreign Application Priority Data

Oct. 24, 2017 (JP) ..... 2017-205473

(51) Int. Cl.
*G03G 15/00* (2006.01)

(52) U.S. Cl.
CPC ..... *G03G 15/5062* (2013.01); *G03G 15/6529* (2013.01)

(58) Field of Classification Search
CPC ..... G03G 15/5062
USPC ..... 399/384
See application file for complete search history.

(56) References Cited

U.S. PATENT DOCUMENTS 3,639,053 A * 2/1972 Spear, Jr. ..... G03G 15/6523 399/385
3,922,082 A * 11/1975 Cavallaro ..... G03G 15/652 399/385
4,885,613 A * 12/1989 Kudoh ..... G03G 15/6517 399/23
4,928,141 A * 5/1990 Poehlein ..... B65H 23/042 399/167
5,708,345 A * 1/1998 Kramer ..... G03G 15/6523 271/258.01
9,073,713 B2 * 7/2015 Ono ..... B41J 11/42
2001/0022422 A1 * 9/2001 Tamura ..... B65H 7/18 271/10.03
2003/0039497 A1 * 2/2003 Shimoyama ..... G03G 15/6517 399/384
2015/0284199 A1 * 10/2015 Kaiga ..... G03G 15/6529 271/3.2

FOREIGN PATENT DOCUMENTS

JP S6263239 U 4/1987
JP 2010254447 A 11/2010
JP 2014201409 A 10/2014

* cited by examiner

*Primary Examiner* — Anthony H Nguyen
(74) *Attorney, Agent, or Firm* — Kim & Stewart LLP

(57) ABSTRACT

A paper feeding device includes a paper roll holder, a first roller that is rotated to convey paper drawn out from the paper roll, a bending portion having a curved inner guide and a curved outer guide between which the paper conveyed by the first roller is conveyed, a second roller that is disposed downstream of the bending portion in a conveying direction of the paper, and configured to be rotated to convey the paper conveyed from the bending portion and to idle when the paper conveyed from the bending portion applies a rotation force thereto, and a control unit configured to control rotation of the first roller so that the first roller conveys the paper at a target conveying speed.

12 Claims, 5 Drawing Sheets

PAPER FEEDING DEVICE

CROSS-REFERENCE TO RELATED APPLICATION

This application is based upon and claims the benefit of priority from Japanese Patent Application No. 2017-205473, filed Oct. 24, 2017, the entire contents of which are incorporated herein by reference.

FIELD

Embodiments described herein relate generally to a paper feeding device.

BACKGROUND

An image forming apparatus forms an image on paper of a predetermined size. There is a need for an image forming apparatus which can feed paper of any size and can form an image thereon. A paper feeding device which supplies paper from paper roll, and feeds the paper to an image forming apparatus main body has been developed. If a paper feeding speed of the paper feeding device is different from a paper conveying speed of the image forming apparatus main body, paper jam may occur.

DETAILED DESCRIPTION

Embodiments provide a paper feeding device capable of preventing the occurrence of a paper jam.

According to an embodiment, there is provided a paper feeding device including a paper roll holder, a first roller that is rotated to convey paper drawn out from the paper roll, a bending portion having a curved inner guide and a curved outer guide between which the paper conveyed by the first roller is conveyed, a second roller that is disposed downstream of the bending portion in a conveying direction of the paper, and configured to be rotated to convey the paper conveyed from the bending portion and to idle when the paper conveyed from the bending portion applies a rotation force thereto, and a control unit configured to control rotation of the first roller so that the first roller conveys the paper at a target conveying speed.

Hereinafter, with reference to the drawings, a paper feeding device of an embodiment will be described. In the present embodiment, XYZ directions are defined as follows. A Z direction is a vertical direction, and an X direction and a Y direction are horizontal directions. The Z direction is an upward-and-downward direction (i.e., height direction). The X direction is a front-and-rear direction (i.e., depth direction) of the image forming apparatus. The Y direction is a leftward-and-rightward direction (i.e., width direction) of the image forming apparatus.

Figure 1:
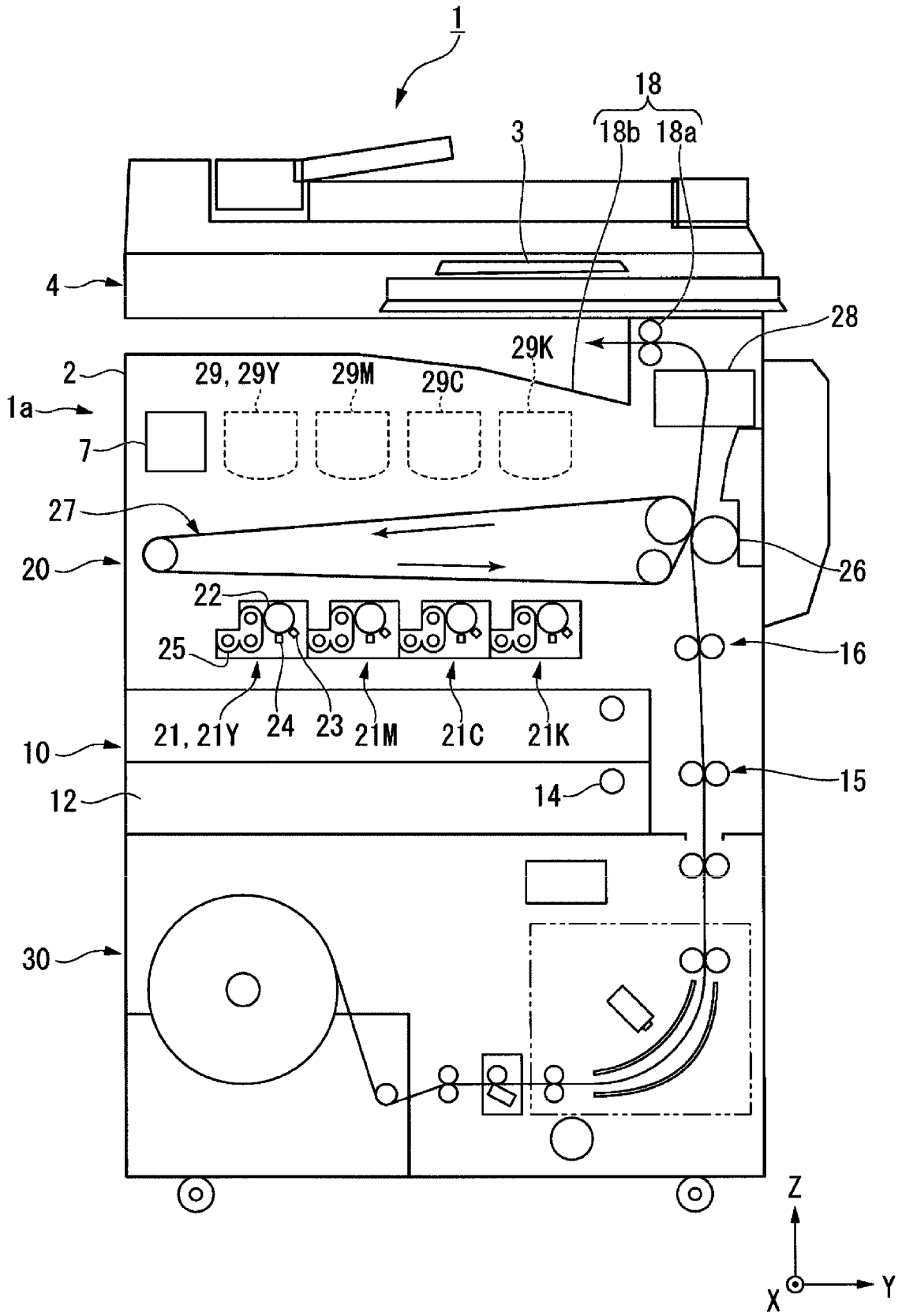
FIG. 1 is a side sectional view of an image forming apparatus.

FIG. 1 is a side sectional view of an image forming apparatus 1. For example, the image forming apparatus 1 is a multi-function peripheral (MFP). The image forming apparatus 1 reads image information of a copy object such as paper, and generates digital data such as an image file. The image forming apparatus 1 forms an image on paper by using a developing agent on the basis of the digital data. For example, the developing agent includes toner. Specifically, the developing agent includes either of a decolorable developing agent and a non-decolorable developing agent.

The details of the image forming apparatus 1 will be described.

As illustrated in FIG. 1, the image forming apparatus 1 includes an image forming apparatus main body 1*a* and a paper feeding device 30. The image forming apparatus main body 1*a* includes a casing 2, a display unit 3, a scanner unit 4, a paper feeding unit 10, a printer unit 20, a paper discharge unit 18, and a main body control unit 7. The main body control unit 7 controls operations of the display unit 3, the scanner unit 4, the paper feeding unit 10, the printer unit 20, and the paper discharge unit 18.

The casing 2 forms an outline of the image forming apparatus main body 1*a*.

The display unit 3 is disposed on a surface of the image forming apparatus main body 1*a*. The display unit 3 displays various pieces of information regarding image formation. The display unit 3 includes a touch panel or the like.

The scanner unit 4 is disposed on an upper part of the image forming apparatus main body 1*a*. The scanner unit 4 reads image information of a copy object as brightness and darkness of light. The scanner unit 4 outputs the read image information to the printer unit 20.

The paper feeding unit 10 feeds and conveys paper of a fixed size. The paper feeding unit 10 includes a paper feeding cassette 12, a pickup roller 14, conveying rollers 15, and registration rollers 16.

The paper feeding cassette 12 is disposed on a lower part of the image forming apparatus main body 1*a*. The paper feeding cassette 12 accommodates paper of a fixed size on which an image is not formed. The pickup roller 14 extracts paper sheets one by one from the paper feeding cassette 12. The pickup roller 14 feeds the paper to the conveying rollers 15.

The conveying rollers 15 convey the paper fed from the pickup roller 14 toward the registration rollers 16. The conveying rollers 15 convey paper fed from the paper feeding device 30 which will be described later toward the registration rollers 16. The registration rollers 16 temporarily catch a leading end of the conveyed paper so as to correct an inclination of the paper. The registration rollers 16 feed the paper to the printer unit 20.

The printer unit 20 is disposed at the center of the image forming apparatus main body 1*a*. The printer unit 20 forms an image on the paper by using a developing agent including toner on the basis of image information from the scanner unit 4 or from external devices. The printer unit 20 includes a toner cartridge accommodation portion 29, an image forming portion 21, an intermediate transfer member 27, a secondary transfer roller 26, and a fixing device 28.

The toner cartridge accommodation portion 29 accommodates toner cartridges filled with toner of respective colors such as yellow (29Y), magenta (29M), cyan (29C), and black (29K).

The image forming portion 21 forms images of respective colors such as yellow (21Y), magenta (21M), cyan (21C), and black (21K). The image forming portion 21 includes photoconductive drums 22, chargers 23, exposure devices 24, and development devices 25.

Each of the photoconductive drums 22 is columnar-shaped. A photoconductive material is disposed on an outer circumferential surface of the photoconductive drum 22. The property of the photoconductive material is to charge static electricity in a dark state, and discharge the static electricity when light is irradiated. The photoconductive drum 22 rotates in a predetermined direction about a central axis.

Each of the chargers 23 charges a surface of the photoconductive drum 22 with the static electricity. For example, the charger 23 has a plurality of needle electrodes. The plurality of needle electrodes are arranged in a rotation axis direction of the photoconductive drum 22. The charger 23 causes the surface of the photoconductive drum 22 to charge the static electricity due to release of the static electricity from the plurality of needle electrodes.

Each of the exposure devices 24 forms an electrostatic latent image corresponding to image information on the surface of the photoconductive drum 22. For example, the exposure device 24 is provided with a laser irradiation device. The laser irradiation device irradiates the surface of the rotated photoconductive drum 22 with laser light based on the image information. A portion irradiated with the laser light in the surface of the photoconductive drum 22 releases the static electricity, and the other non-irradiated portion holds the static electricity. Consequently, the exposure device 24 forms an electrostatic latent image corresponding to image information on the surface of the photoconductive drum 22.

Each of the development devices 25 supplies toner to the surface of the photoconductive drum 22 so as to develop the electrostatic latent image with the toner. The toner is supplied to the development device 25 from the toner cartridge accommodated in the toner cartridge accommodation portion 29. A two-component developing agent containing toner and a carrier is stored in the development device 25. The carrier delivers the toner from the development device 25 to the photoconductive drum 22. In the surface of the photoconductive drum 22, a portion from which the static electricity is released due to exposure adsorbs toner negatively charged. Consequently, the development device 25 develops the electrostatic latent image on the photoconductive drum 22 with the toner.

The intermediate transfer member 27 is an endless belt. The intermediate transfer member 27 is disposed facing the image forming portion 21 which forms images with the respective colors. An outer surface of the intermediate transfer member 27 is disposed to be close to the photoconductive drum 22. A positive voltage is applied from the inside of the intermediate transfer member 27. The negatively charged toner is transferred from the photoconductive drum 22 to the intermediate transfer member 27. Consequently, a toner image on the photoconductive drum 22 is transferred onto the intermediate transfer member 27. Toner images are formed by the respective colors presented on the intermediate transfer member 27.

The secondary transfer roller 26 is disposed adjacent to the intermediate transfer member 27. The secondary transfer roller 26 presses conveyed paper to the intermediate transfer member 27 such that a first surface of the paper comes into contact with the outer circumferential surface of the intermediate transfer member 27. The secondary transfer roller 26 applies a positive voltage from a second surface side of the paper which is opposite to the first surface side. The negatively charged toner is transferred from the intermediate transfer member 27 onto the first surface of the paper. Consequently, the secondary transfer roller 26 causes the toner image on the intermediate transfer member 27 to transfer to the paper.

The fixing device 28 fixes the toner image to the paper. For example, the fixing device 28 includes a heating roller and a pressing roller. The paper onto which the toner image is transferred passes through a nip formed between the heating roller and the pressing roller. The heating roller heats the toner, and the pressing roller presses the toner against the paper. The toner transitions from powder to a fluid, and permeates into fibers of the paper. The toner is cooled to be solidified, and is fixed to the paper. Consequently, the fixing device 28 fixes the toner image to the paper. As mentioned above, the image is formed on the paper.

The paper discharge unit 18 includes paper discharge rollers 18*a* and a paper discharge tray 18*b*. The paper discharge rollers 18*a* discharge the paper on which the image is formed to the paper discharge tray 18*b*. The paper, on which the image is formed, is accumulated on the paper discharge tray 18*b*. The paper discharge tray 18*b* is disposed between the scanner unit 4 and the printer unit 20.

The paper feeding device 30 feeds paper to the image forming apparatus main body 1*a*. The paper feeding device 30 is disposed on the lower part of the image forming apparatus main body 1*a*. The paper feeding device 30 has a size in the Y direction that is equivalent to that of the image forming apparatus main body 1*a*. The paper feeding device 30 is attachable to and detachable from the image forming apparatus main body 1*a*. The paper feeding device 30 may be replaced with a paper feed pedestal (PFP) or a large capacity feeder (LCF).

The details of the paper feeding device 30 will be described.

Figure 2:
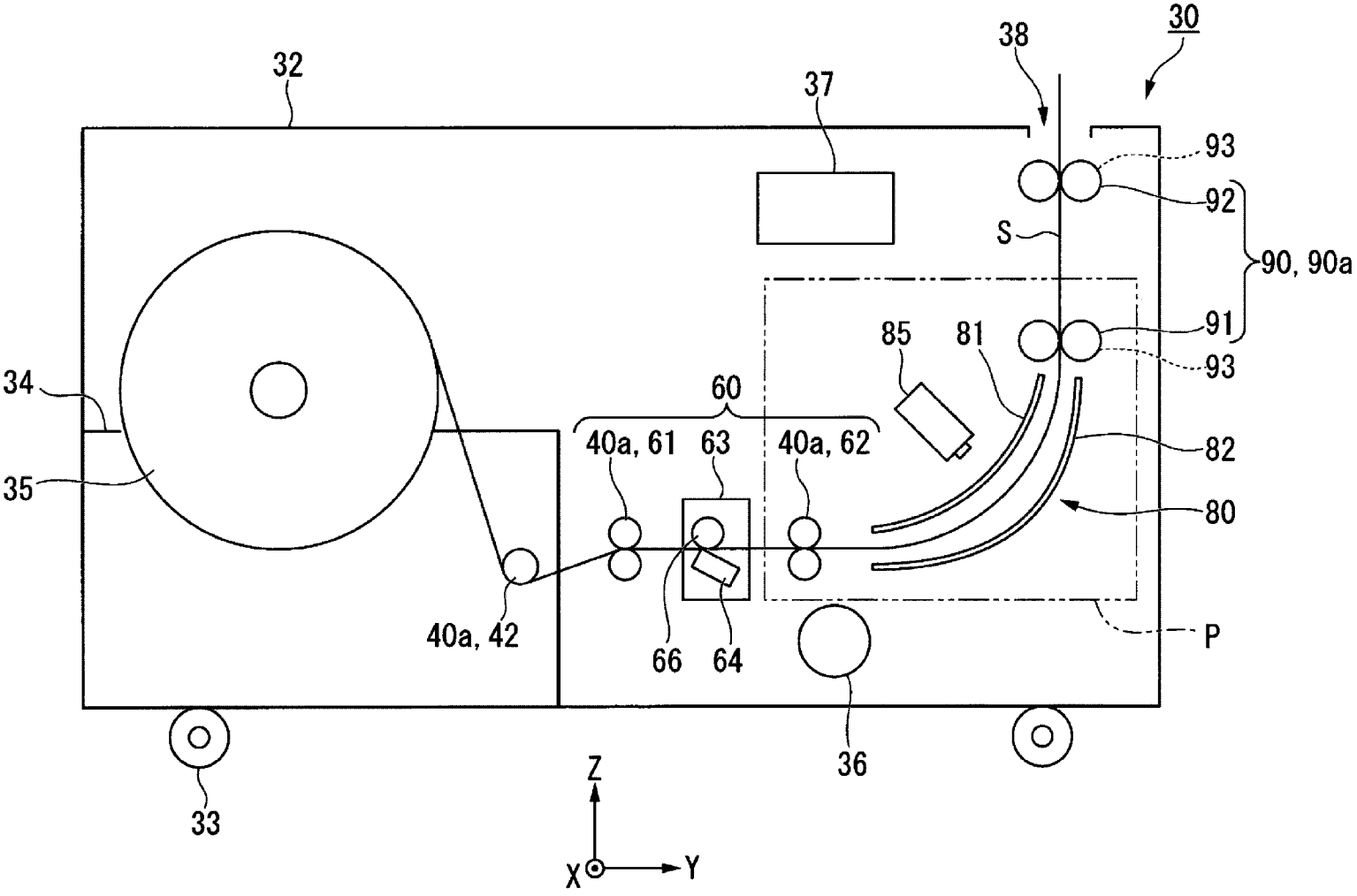
FIG. 2 is a side sectional view of a paper feeding device according to an embodiment.

FIG. 2 is a side sectional view of the paper feeding device of the embodiment.

The paper feeding device 30 feeds paper S from paper roll 35 to the image forming apparatus main body 1*a*. The paper roll 35 is the wound paper S. The paper is wound in a state in which a printing surface thereof is directed inward or outward depending on a structure of the image forming apparatus main body 1*a*. In this embodiment, the paper is wound in a state in which a printing surface is directed outward. For example, the paper S is plain paper or label paper. The label paper has a label, an adhesive paste, and a mount. The adhesive paste is disposed between the label and the mount. An operator of the image forming apparatus 1 selects a continuous paper feeding mode or a cut paper feeding mode as a feeding mode of the paper S. The continuous paper feeding mode is a mode in which the paper S of the paper roll 35 is continuously fed without being cut by a cutting portion 60. The cut paper feeding mode is a mode in which the paper S of the paper roll 35 is cut by the cutting portion 60, and is fed. The operator of the image forming apparatus 1 inputs a paper feeding mode on the display unit 3 of the image forming apparatus 1.

The paper feeding device 30 includes a case 32 and a cassette 34. The case 32 forms an outline of the paper feeding device 30. The case 32 has casters 33 on a lower surface thereof. The case 32 has an outlet 38 through which the paper S is sent to the outside thereof. The outlet 38 is formed on a top surface of the case 32. The outlet 38 is disposed at a first end part of the case 32 in the Y direction. The cassette 34 is a paper roll accommodation portion in which the paper roll 35 can be accommodated. The cassette 34 is disposed at a second end part of the case 32 in the Y direction. There is a gap between the cassette 34 and the outlet 38 in the Y direction. The cassette 34 can be extracted from the case 32 in the horizontal direction. The paper roll 35 is accommodated in the cassette 34 extracted from the case 32. The cassette 34 rotatably supports a central shaft of the paper roll 35. The cassette 34 may be provided with a mechanism which rotationally drives the central shaft of the paper roll 35. If the central shaft of the paper roll 35 is rotationally driven by the mechanism, the paper S is drawn out from the paper roll 35.

The paper feeding device 30 includes a motor 36 and a control unit 37. The motor 36 rotationally drives various rollers described below, and conveys the paper S of the paper roll 35. The control unit 37 controls operations of the paper feeding device 30.

The paper feeding device 30 includes a tension roller 42, the cutting portion 60, a bending portion 80, and an outlet portion 90 in this order along a conveying direction of the paper S of the paper roll 35 (hereinafter, simply referred to as a "conveying direction").

The tension roller 42 is positioned in a conveying path of the paper S released from the paper roll 35. The tension roller 42 exerts a force on the paper S released from the paper roll 35 in an opposite direction to that of the force applied by the paper S against the tension roller 42 as a result of the tension in the paper S. The position of the tension roller 42 moves up and down in accordance with a change in the tension in the paper S.

The cutting portion 60 cuts the paper S while conveying the paper S. The cutting portion 60 is supported at the case 32. The cutting portion 60 includes a pair of cutting portion rollers 61 and 62, and a rotary cutter 63. The pair of cutting portion rollers 61 and 62 forms the upstream side rollers 40*a*.

The pair of cutting portion rollers 61 and 62 are configured to convey the paper S. The pair of cutting portion rollers 61 and 62 includes a cutting portion first roller 61 and a cutting portion second roller 62. The cutting portion first roller 61 is disposed on the upstream side of the rotary cutter 63 in the conveying direction. The cutting portion second roller 62 is disposed on the downstream side of the rotary cutter 63 in the conveying direction. Each of the cutting portion rollers 61 and 62 has a driving roller and a driven roller. The driving roller and the driven roller sandwiches the paper S therebetween and convey it by rotation thereof. The driving roller is rotationally driven by the motor 36. The driven roller is rotated according to rotation of the driving roller. Each of the cutting portion rollers 61 and 62 include a roller pair and nips and conveys the paper S at a nip between the roller pair. Each of the roller pair of the cutting portion rollers 61 and 62 includes a driving roller and a driven roller. The nips of the pair of cutting portion rollers 61 and 62 are disposed in parallel to each other. Consequently, the paper S is held in a planar shape between the pair of cutting portion rollers 61 and 62. The pair of cutting portion rollers 61 and 62 conveys the paper S such that the paper S is bridged in a planar shape between the cutting portion rollers 61 and 62. A conveying speed of the paper S of the cutting portion rollers 61 and 62 is controlled by the control unit 37.

The rotary cutter 63 cuts the paper S. The rotary cutter 63 has a rotary tooth 66 and a fixed tooth 64. The rotary tooth 66 is disposed on an outer circumferential surface of a rotary tooth support member which is formed in a columnar shape. The rotary tooth 66 spirally extends from a first end part of the rotary tooth support member to a second end part thereof in an axial direction. The rotary tooth support member is rotatably supported about a rotation axis orthogonal to a paper conveying direction. The fixed tooth 64 has a rectangular plate shape. The rotary tooth 66 rotates to cut the paper S nipped between the rotary tooth 66 and the fixed tooth 64. The rotary tooth 66 has a spiral shape, and thus the paper S which is being conveyed is cut vertically to the conveying direction. The pair of cutting portion rollers 61 and 62 illustrated in FIG. 2 conveys the paper S in a planar shape at the position of the rotary cutter 63. Consequently, the rotary cutter 63 linearly cuts the paper S which is being conveyed.

The outlet portion 90 conveys the paper S toward the outlet 38 through which the paper S is sent to the outside of the case 32. The outlet portion 90 is supported at the case 32. The outlet portion 90 has a plurality of outlet portion rollers 91 and 92. The plurality of outlet portion rollers 91 and 92 are downstream side rollers 90*a*. The plurality of outlet portion rollers 91 and 92 include an outlet portion first roller 91 and an outlet portion second roller 92. The outlet portion first roller 91 is disposed near the downstream side of the bending portion 80 in the conveying direction. The outlet portion second roller 92 is disposed near the upstream side of the outlet 38 in the conveying direction. Each of the outlet portion rollers 91 and 92 has a driving roller and a driven roller. The driving roller and the driven roller of each of the outlet portion rollers 91 and 92 sandwiches the paper S therebetween and convey it by rotation thereof. The driving roller is rotationally driven by the motor 36. The driven roller rotates according to rotation of the driving roller. A conveying speed of the paper S of the outlet portion rollers 91 and 92 is controlled by the control unit 37.

Each of the outlet portion rollers 91 and 92 is provided with a one-way clutch 93 in a transmission path of from the motor 36 to the driving roller of the outlet portion rollers 91 and 92. The one-way clutch 93 has a clutch mechanism which transmits rotation force only in one direction. The one-way clutch 93 engages the motor 36 to the driving roller such that the rotation force in the conveying direction is transmitted from the motor 36 to the outlet portion rollers 91 and 92. Conversely, the one-way clutch 93 disengages the motor 36 from the driving roller such that the rotation force in the conveying direction is not transmitted from the outlet portion rollers 91 and 92 to the motor 36. Consequently, the driving roller of the outlet portion rollers 91 and 92 idles if rotation force is applied thereto from the paper S.

The bending portion 80 holds the paper S to be bent. The bending portion 80 is disposed between the upstream side rollers 40*a* and the downstream side rollers 90*a*. The conveying direction of the paper S in the upstream side rollers 40*a* is the Y direction. The conveying direction of the paper S in the downstream side rollers 90*a* is the Z direction. The conveying direction changes from the Y direction to the Z direction between the upstream side rollers 40*a* and the downstream side rollers 90*a*. The bending portion 80 is disposed at a location where the conveying direction changes. On the path of the conveying direction, there is a curve where the conveying direction changes.

Figure 3:
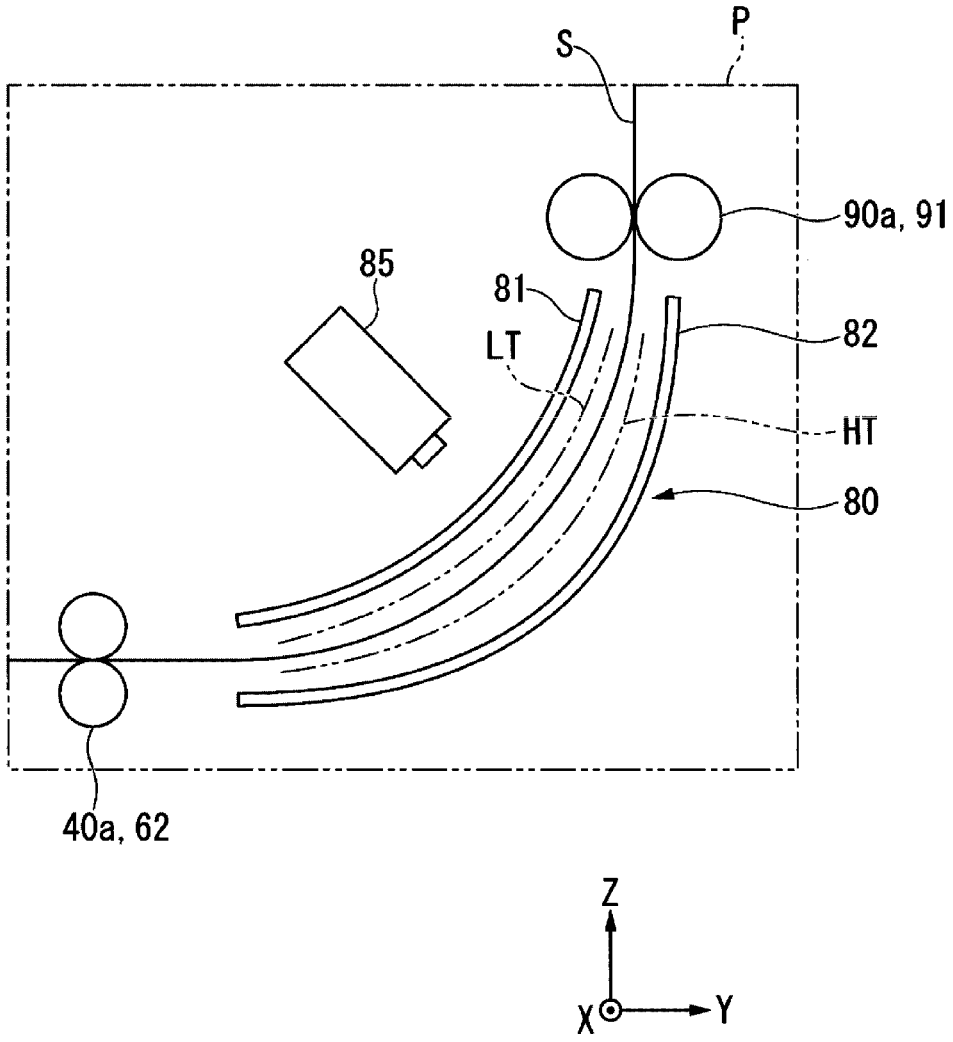
FIG. 3 is an enlarged view of the periphery of a bending portion of the paper feeding device.

FIG. 3 is an enlarged view of the periphery (P part in FIG. 2) of the bending portion. The bending portion 80 includes an inside guide 81, an outside guide 82, and a bending amount measurement sensor 85.

The inside guide 81 is disposed on an inner side of the curved portion. The outside guide 82 is disposed on an outer side of the curved portion. The inside guide 81 and the outside guide 82 are curved along the conveying direction. A radius of curvature of the inside guide 81 is larger than a radius of curvature of the outside guide 82. Consequently, a gap between the inside guide 81 and the outside guide 82 is narrower at an upstream portion and a downstream portion in the conveying direction, and is wider at a middle stream.

The bending amount measurement sensor 85 is used to measure a bending amount of the paper S in the bending portion 80. The bending amount measurement sensor 85 is, for example, an optical ranging sensor. The bending amount measurement sensor 85 is disposed on an inner side of the inside guide 81. The bending amount measurement sensor 85 calculates a distance to the paper S on the basis of time required for emitted light to travel to and return from the paper S, and outputs the calculated distance to the control unit 37. The control unit 37 determines the bending amount of the paper S in the bending portion 80 on the basis of the output from the bending amount measurement sensor 85. The shortest path of the paper S in the bending portion 80 is a path along an outer circumference of the inside guide 81. When the paper S passes along a path separated from the outer circumference of the inside guide 81 in the bending portion 80, the paper S is in a bent state. In this state, the "bending amount of the paper S" is defined as a distance from the outer circumference of the inside guide 81 to the paper S. The control unit 37 determines the bending amount of the paper S by subtracting the distance between the bending amount measurement sensor 85 and the outer circumference of the inside guide 81, from the distance between the bending amount measurement sensor 85 and the paper S.

Generally, a paper feeding speed of the paper feeding device 30 is set to a standard conveying speed, which is a standard conveying speed of the paper S in the image forming apparatus main body 1*a*. Hereinafter, a conveying speed of the paper S in the image forming apparatus main body 1*a* will be referred to as a conveying speed in the image forming apparatus main body 1*a*. A conveying speed of the paper S in the paper feeding device 30 (hereinafter, referred to as a conveying speed in the paper feeding device 30) is set to a standard paper feeding speed. In other words, a conveying speed of the paper feeding device 30 and a conveying speed of the image forming apparatus main body 1*a* are all set to a standard conveying speed. However, a conveying speed of some of the rollers of the paper feeding device 30 may be different from the standard paper feeding speed. For example, a conveying speed of the cutting portion rollers 61 and 62 may be set to an upper limit speed or lower at which the paper S can be cut with the rotary cutter 63.

However, there is a case where either one of the conveying speed of the paper feeding device 30 and the conveying speed of the image forming apparatus main body 1*a* may deviate from the standard conveying speed due to a manufacturing variation or the like. In other words, the conveying speed of the paper feeding device 30 may be different from the conveying speed of the image forming apparatus main body 1*a*. For example, the conveying speed of the paper feeding device 30 may be lower than the conveying speed of the image forming apparatus main body 1*a*. In this case, the image forming apparatus main body 1*a* pulls the paper S with respect to the paper feeding device 30. Consequently, there is a case where excessive tensile stress acts on the paper S, and thus the paper S is damaged.

In the paper feeding device 30 of the present embodiment, the outlet portion rollers 91 and 92 which are the downstream side rollers 90*a* are provided with the one-way clutches 93. If the image forming apparatus main body 1*a* pulls the paper S, rotation force in the conveying direction acts on the outlet portion rollers 91 and 92. The one-way clutches 93 disconnect the rotation force such that the rotation force in the conveying direction is not transmitted from the outlet portion rollers 91 and 92 to the motor 36. Consequently, the outlet portion rollers 91 and 92 idle, and thus excessive tensile stress does not act on the paper S. Therefore, the paper jam due to damage of the paper S does not occur.

In the continuous paper feeding mode, the paper S extends from the paper roll 35 to the image forming apparatus main body 1*a*. When the image forming apparatus main body 1*a* pulls the paper S, the downstream side rollers 90*a* idle due to disengagement of the one-way clutches 93, but the upstream side rollers 40*a* do not idle. Thus, there is a probability that excessive tensile stress may act on the paper S. In the paper feeding device 30 of the present embodiment, the bending portion 80 is provided between the upstream side rollers 40*a* and the downstream side rollers 90*a*. If the image forming apparatus main body 1*a* pulls the paper S, and thus the downstream side rollers 90*a* idle, a bending amount of the paper S in the bending portion 80 is reduced. In other words, the bending portion 80 absorbs a conveying speed difference between the image forming apparatus main body 1*a* and the paper feeding device 30. Consequently, excessive tensile stress does not act on the paper S, and thus the paper jam due to damage of the paper S does not occur.

If a state in which a conveying speed of the paper feeding device 30 is lower than a conveying speed of the image forming apparatus main body 1*a* is continued, a bending amount of the paper S in the bending portion 80 is continuously reduced. If the image forming apparatus main body 1*a* pulls the paper S in a state in which a bending amount of the paper S is zero, excessive tensile stress acts on the paper S. The control unit 37 of the present embodiment determines a bending amount of the paper S at a predetermined time period by using the bending amount measurement sensor 85. If the control unit 37 determines that a bending amount of the paper S is less than a first value LT, the control unit 37 controls the upstream side rollers 40*a* to increase a conveying speed thereof. If the control unit 37 determines that a bending amount of the paper S is more than a second value HT, the control unit 37 reduces a conveying speed of the upstream side rollers 40*a*. Consequently, the control unit 37 controls a conveying speed of the upstream side rollers 40*a* of the paper feeding device 30 to be equivalent to a conveying speed of the image forming apparatus main body 1*a*. Consequently, excessive tensile stress does not act on the paper S, and thus the paper jam due to damage of the paper S does not occur.

On the other hand, in a case of the cut paper feeding mode, if the image forming apparatus main body 1*a* pulls the paper S, the downstream side rollers 90*a* of the paper feeding device 30 idle. However, the cut paper S does not extend continuously from the image forming apparatus main body 1*a* to the upstream side rollers 40*a* of the paper feeding device 30. Thus, excessive tensile stress does not act on the paper S, and thus the paper jam due to damage of the paper S does not occur. Here, if the cut paper feeding mode is selected, the control unit 37 does not control a conveying speed of the upstream side rollers 40*a*. In other words, the control unit 37 does not perform control of a bending amount of the paper S, which is performed in the continuous paper feeding mode. In this case, the control unit 37 does not calculate a bending amount of the paper S by using the bending amount measurement sensor 85. The control unit 37 does not adjust a conveying speed of the upstream side rollers 40*a*. The control unit 37 controls conveying speeds in the upstream side rollers 40*a* and the downstream side rollers 90*a* to be a predetermined speed lower than the standard paper feeding speed. Also in this case, since the downstream side rollers 90*a* idle, and thus excessive tensile stress does not act on the paper S, the paper jam due to damage of the paper S does not occur.

A paper feeding method of the continuous paper feeding mode will be described in detail.

Figure 5:
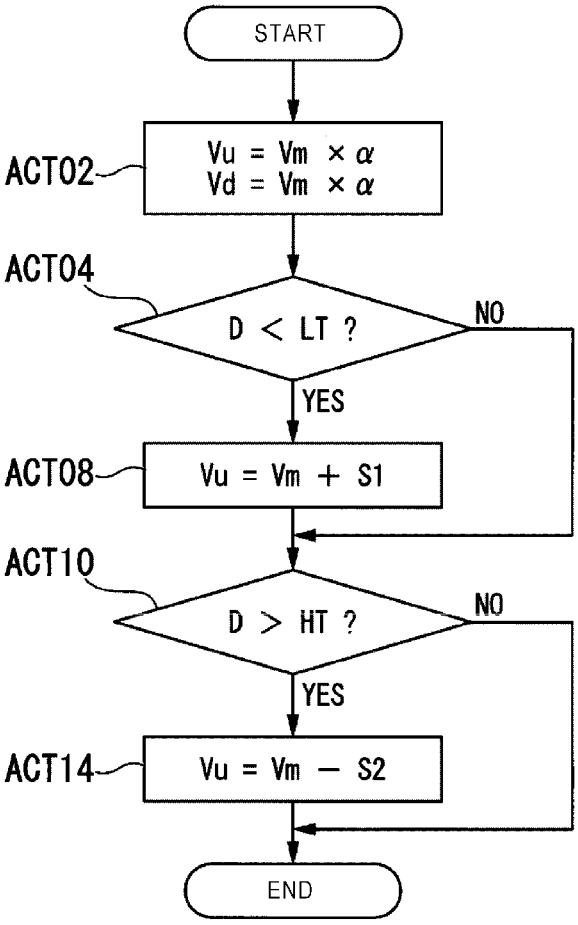
FIG. 5 is a flowchart illustrating a paper feeding method.

FIG. 5 is a flowchart illustrating a paper feeding method.

If the continuous paper feeding mode is selected by an operator, the control unit 37 controls the upstream side rollers 40*a* to start rotating. In a case where the paper feeding device 30 includes a mechanism for rotating the central shaft of the paper roll 35, rotational driving of the central shaft of the paper roll 35 is also started.

A conveying speed Vu in the upstream side rollers 40*a* is set to be lower than a conveying speed of the image forming apparatus main body 1*a*. The control unit 37 sets the conveying speed Vu in the upstream side rollers 40*a* to be several percent lower than the above-described standard conveying speed Vm, which is the standard conveying speed of the paper S of the image forming apparatus main body 1*a*. The control unit 37 sets the conveying speed Vu in the upstream side rollers 40*a* to, for example, $Vm \times \alpha$ (where $\alpha<1.0$) (ACT 02).

If the upstream side rollers 40*a* rotate, the paper S of the paper roll 35 is conveyed. The paper S passes through the bending portion 80, and the outlet portion first roller 91 temporarily holds a leading end of the paper S. Consequently, the paper S is bent in the bending portion 80. After the paper S is bent, the control unit 37 controls the downstream side rollers 90*a* to start rotating. The control unit 37 may simultaneously controls the upstream side rollers 40*a* and the downstream side rollers 90*a* to start rotating.

A conveying speed Vd of the downstream side rollers 90*a* is set to be lower than the conveying speed of the image forming apparatus main body 1*a*. The control unit 37 sets the conveying speed Vd of the downstream side rollers 90*a* to be the same as the conveying speed Vu of the upstream side rollers 40*a*. The control unit 37 sets the conveying speed Vd of the downstream side rollers 90*a* to be several percent lower than the standard conveying speed Vm. The control unit 37 sets the conveying speed Vd in the downstream side rollers 90*a* to, for example, $Vm \times \alpha$ (where $\alpha<1.0$) (ACT 02).

The paper feeding device 30 feeds the paper S to the image forming apparatus main body 1*a* at the conveying speed Vd in the downstream side rollers 90*a*. The conveying speed Vd in the downstream side rollers 90*a* is set to be lower than the conveying speed of the image forming apparatus main body 1*a*. Thus, jamming of the paper S does not occur along the paper feeding path between the image forming apparatus main body 1*a* and the paper feeding device 30. Since the conveying speed of the image forming apparatus main body 1*a* is higher than the conveying speed Vd of the downstream side rollers 90*a*, the image forming apparatus main body 1*a* pulls the paper S from the downstream side rollers 90*a*. Since the downstream side rollers 90*a* idle due to the one-way clutch 93, excessive tensile stress does not act on the paper S.

Since the conveying speed of the image forming apparatus main body 1*a* is higher than the conveying speed Vu of the upstream side rollers 40*a*, a bending amount of the paper S in the bending portion 80 is reduced. The control unit 37 causes the bending amount measurement sensor 85 to measure a bending amount of the paper S at a predetermined time period.

The control unit 37 determines whether or not the measured bending amount D is less than the first value LT (ACT 04). If the determination in ACT 04 is YES, the control unit 37 controls the upstream side rollers 40*a* to increase the conveying speed Vu thereof. In this case, the conveying speed Vu of the upstream side rollers 40*a* is set to be higher than the conveying speed of the image forming apparatus main body 1*a*. The control unit 37 controls the conveying speed Vu of the upstream side rollers 40*a* to be a speed Vm+S1, which is higher than the standard conveying speed Vm by S1 (ACT 08). Since the downstream side rollers 90*a* idle due to the one-way clutches 93, the conveying speed Vd of the downstream side rollers 90*a* is set to be the same as the conveying speed of the image forming apparatus main body 1*a*. Thus, the conveying speed Vu in the upstream side rollers 40*a* becomes higher than the conveying speed Vd in the downstream side rollers 90*a*. Consequently, a bending amount of the paper S is likely to increase.

If the determination in ACT 04 is YES, the control unit 37 may control the upstream side rollers 40*a* to increase the conveying speed Vu by a predetermined speed. In this case, the conveying speed Vu in the upstream side rollers 40*a* in ACT 08 is Vu=Vu+Sa.

If the determination in ACT 04 is NO, which indicates a state that the bending amount D is equal to or more than the first value LT, the flow proceeds to ACT 10.

The control unit 37 determines whether or not the measured bending amount D is more than the second value HT (ACT 10). If the determination in ACT 10 is YES, the control unit 37 reduces the conveying speed Vu of the upstream side rollers 40*a*. In this case, the conveying speed Vu in the upstream side rollers 40*a* is set to be lower than the conveying speed of the image forming apparatus main body 1*a*. The control unit 37 controls the conveying speed Vu in the upstream side rollers 40*a* to be a speed Vm−S2, which is lower than the standard conveying speed Vm by S2 (ACT 14). Since the downstream side rollers 90*a* idle due to the one-way clutches 93, the conveying speed Vd in the downstream side rollers 90*a* is set to be the same as the conveying speed of the image forming apparatus main body 1*a*. Thus, the conveying speed Vu in the upstream side rollers 40*a* becomes lower than the conveying speed Vd in the downstream side rollers 90*a*. Consequently, a bending amount of the paper S decreases.

If the determination in ACT 10 is YES, the control unit 37 may reduce the conveying speed Vu in the upstream side rollers 40*a* with respect to Vu by a predetermined speed. In this case, the conveying speed Vu in the upstream side rollers 40*a* in ACT 14 is Vu=Vu−Sb.

If the determination in ACT 10 is NO, which indicates a state that the bending amount D is equal to or less than the second value HT, the process is finished.

The control unit 37 repeatedly performs the above-described control. Consequently, the conveying speed Vu in the upstream side rollers 40*a* is equivalent to the conveying speed of the image forming apparatus main body 1*a*. A bending amount of the paper S in the bending portion 80 is held between the first value LT and the second value HT. Consequently, continuous paper feeding to the image forming apparatus main body 1*a* from the paper feeding device 30 is stably realized.

The paper feeding device 30 of the embodiment includes the cassette 34, the upstream side rollers 40*a*, the downstream side rollers 90*a*, the bending portion 80, and the control unit 37. The cassette 34 accommodates the paper roll 35. The upstream side rollers 40*a* are disposed on the downstream side of the cassette 34 in the conveying direction of the paper S of the paper roll 35. The upstream side rollers 40*a* convey the paper S. The downstream side rollers 90*a* are disposed on the downstream side of the upstream side rollers 40*a* in the conveying direction. The downstream side rollers 90*a* convey the paper S. The downstream side rollers 90*a* idle if rotation force in the conveying direction acts thereon from the paper S. The bending portion 80 is disposed between the upstream side rollers 40*a* and the downstream side rollers 90*a* in the conveying direction. The bending portion 80 holds the paper S to be bent. The control unit 37 controls a conveying speed of the paper S of the upstream side rollers 40*a*.

If a conveying speed of the paper feeding device 30 is lower than a conveying speed of the image forming apparatus main body 1*a*, there is a probability that excessive tensile stress may act on the paper S. In the paper feeding device 30 of the embodiment, since the downstream side rollers 90*a* idle if rotation force in the conveying direction acts from the paper S, excessive tensile stress does not act on the paper S. Although the upstream side rollers 40*a* do not idle, the bending portion 80 is disposed between the upstream side rollers 40*a* and the downstream side rollers 90*a*. The control unit 37 controls a conveying speed of the paper S of the upstream side rollers 40*a*, and the bending portion 80 holds the paper S to be bent. The bending portion 80 absorbs a conveying speed difference between the paper feeding device 30 and the image forming apparatus main body 1*a*, and thus excessive tensile stress does not act on the paper S. Therefore, the paper jam due to damage of the paper S does not occur.

In the continuous paper feeding mode in which the paper S delivered from the paper roll 35 is continuously fed without being cut, the control unit 37 starts to cause to feed the paper S at a speed lower than a preset standard paper feeding speed.

If a conveying speed of the paper feeding device 30 is higher than a conveying speed of the image forming apparatus main body 1*a*, there is a probability that jamming of the paper S may occur. In the paper feeding device 30 of the embodiment, the control unit 37 starts to cause to feed the paper S at a speed lower than the standard paper feeding speed.

Consequently, a state in which a conveying speed of the paper feeding device 30 is lower than that of the image forming apparatus main body 1*a* is intentionally realized. Therefore, the paper jam due to jamming of the paper S does not occur. As mentioned above, excessive tensile stress does not act on the paper S, and thus the paper jam due to damage of the paper S does not occur either.

The control unit 37 causes the bending amount measurement sensor 85 to measures a bending amount of the paper S in the bending portion 80. If the control unit 37 detects that a bending amount of the paper S is less than the first value LT, the control unit 37 increases a conveying speed of the paper S of the upstream side rollers 40*a*. If the control unit 37 detects that a bending amount of the paper S is more than the second value HT, the control unit 37 reduces a conveying speed of the paper S of the upstream side rollers 40*a*.

If the conveying speed of the upstream side rollers 40*a* is lower than that of the downstream side rollers 90*a*, a bending amount of the paper S in the bending portion 80 is reduced. If the conveying speed of the upstream side rollers 40*a* is higher than that of the downstream side rollers 90*a*, a bending amount of the paper S in the bending portion 80 is increased. The control unit 37 controls a conveying speed of the upstream side rollers 40*a* as mentioned above, and thus the conveying speed of the upstream side rollers 40*a* becomes equivalent to the conveying speed in the downstream side rollers 90*a*. Since the downstream side rollers 90*a* idle if rotation force in the conveying direction acts from the paper S, a conveying speed of the downstream side rollers 90*a* becomes the same as a conveying speed of the image forming apparatus main body 1*a*. In other words, conveying speeds in the upstream side rollers 40*a* and the downstream side rollers 90*a* of the paper feeding device 30 become equivalent to a conveying speed of the image forming apparatus main body 1*a*. Therefore, the paper jam due to damage or jamming of the paper S does not occur.

The bending portion 80 is disposed at the location where the conveying direction changes.

On the path of the conveying direction, there is a curve where the conveying direction changes. With the bending portion 80, bending of the paper S is stably formed.

The paper feeding device 30 has the cutting portion 60 cutting the paper S. In the cut paper feeding mode in which the paper S of the paper roll 35 is cut in the cutting portion 60 so as to be fed, the control unit 37 controls the conveying speed of the paper in the upstream side rollers 40*a* to be a predetermined speed.

The cut paper S does not continuously extend from the upstream side rollers 40*a* of the paper feeding device 30 to image forming apparatus main body 1*a*. Thus, even if a conveying speed of the paper feeding device 30 is lower than a conveying speed of the image forming apparatus main body 1*a*, excessive tensile stress does not act on the paper S, and thus the paper jam due to damage of the paper S does not occur. Therefore, a conveying speed of the upstream side rollers 40*a* is not required to be controlled. The control unit 37 controls conveying speeds of the upstream side rollers 40*a* and the downstream side rollers to be a predetermined speed lower than the standard paper feeding speed. Thus, the paper jam due to jamming of the paper S does not occur. Since the downstream side rollers 90*a* idle, and thus excessive tensile stress does not act on the paper S, the paper jam due to damage of the paper S does not occur.

Figure 4:
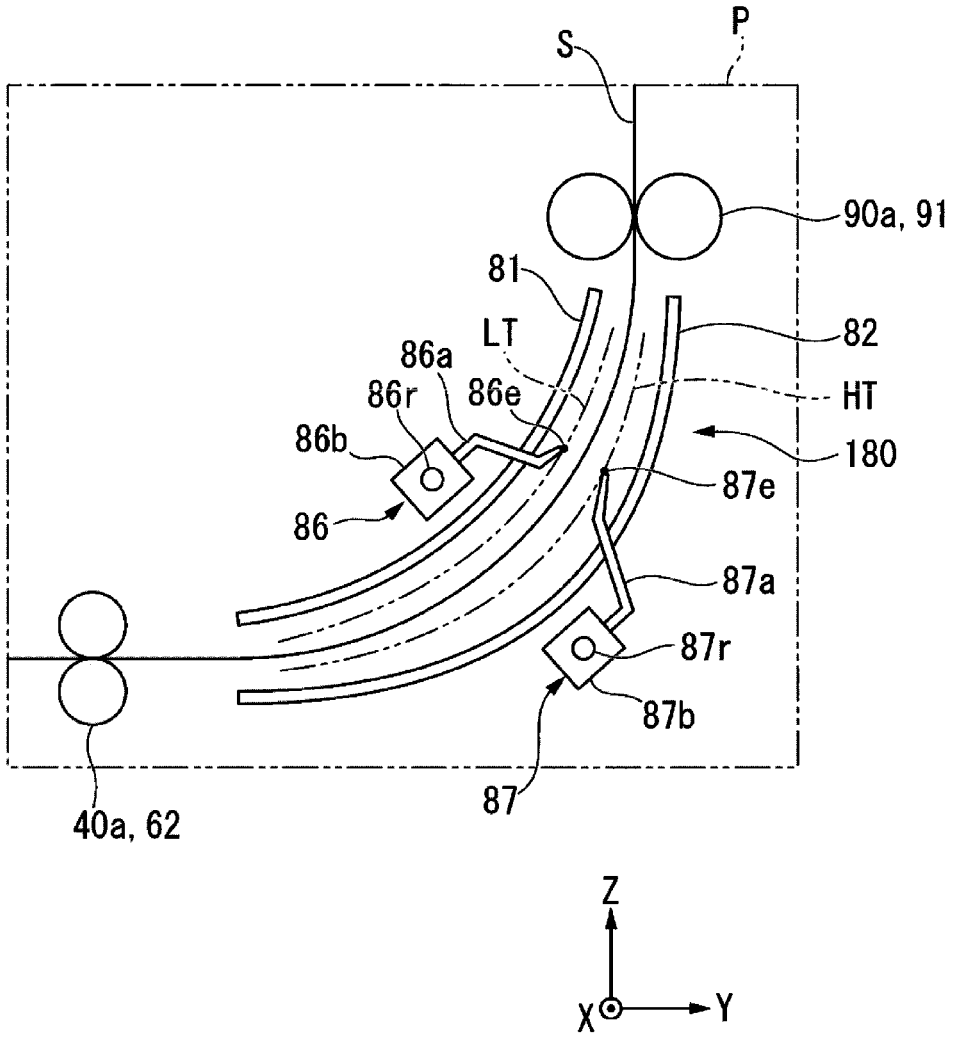
FIG. 4 is an enlarged view of the periphery of the bending portion in a modification example of the embodiment.

FIG. 4 is an enlarged view of the periphery of the bending portion in a modification example of the embodiment. The bending portion 80 of the embodiment includes the bending amount measurement sensor 85, but a bending portion 180 of the modification example includes bending amount measurement actuators. A description of the same configuration in the modification example as the configuration in the embodiment will be omitted.

The bending amount measurement actuators include an inside actuator 86 and an outside actuator 87.

The inside actuator 86 includes a main body part 86*b* and an arm part 86*a*. The main body part 86*b* is disposed on an inner side of the inside guide 81. The arm part 86*a* extends outward of the inside guide 81 from the main body part 86*b*. The arm part 86*a* is supported at the main body part 86*b* to be rotatable about a rotation shaft 86*r*. A tip 86*e* of the arm part 86*a* is directed toward a position corresponding to the first value LT of a bending amount of the paper S, and is biased to be in that position by a biasing member (not illustrated).

The outside actuator 87 is symmetric to the inside actuator 86. A tip 87*e* of an arm part 87*a* of the outside actuator 87 is directed toward a position corresponding to the second value HT of a bending amount of the paper S, and is biased to be in that position by a biasing member (not illustrated).

If a bending amount of the paper S is less than the first value LT, the paper S presses the tip 86*e* of the arm part 86*a* of the inside actuator 86 toward the inside guide 81 against a force of the biasing member. Consequently, the inside actuator 86 is turned on, and the inside actuator 86 transmits an ON signal to the control unit 37. The control unit 37 receiving the ON signal from the inside actuator 86 detects that the bending amount of the paper S is less than the first value LT. Consequently, the control unit 37 increases a conveying speed of the paper S of the upstream side rollers 40*a*.

The outside actuator 87 is operated in the same manner as the inside actuator 86. If a bending amount of the paper S is more than the second value HT, the outside actuator 87 transmits an ON signal to the control unit 37. The control unit 37 detects that the bending amount of the paper S is more than the second value HT, and reduces a conveying speed of the paper S of the upstream side rollers 40*a*.

Also in the paper feeding device 30 including the bending portion 180 of the modification example, the paper jam does not occur in the same manner as the paper feeding device 30 including the bending portion 80 of the embodiment.

The image forming apparatus main body 1*a* set forth above is an example, and other configurations may be employed.

The paper feeding device 30 of the embodiment is configured to rotationally drive the respective rollers with the motor 36. In contrast, the respective rollers may be rotationally driven by different motors. For example, the upstream side rollers 40*a* and the downstream side rollers 90*a* may be rotationally driven by different motors. In this case, control of a conveying speed of the upstream side rollers 40*a* is easily performed. The mechanism which rotationally drives the central shaft of the paper roll 35 may be rotationally driven by a different motor.

Other components may be added to the paper feeding device 30. For example, the paper feeding device 30 may be provided with a paste removal portion or a curl correction portion. The paste removal portion removes a leaked adhesive paste around a label if the paper S is label paper. The curl correction portion corrects curls of the paper S delivered from the paper roll 35. For example, the paste removal portion or the curl correction portion is disposed between the tension roller 42 and the cutting portion 60 along the conveying direction.

According to at least one embodiment described above, the paper feeding device 30 includes the upstream side rollers 40*a*, the downstream side rollers 90*a*, and the control unit 37. The downstream side rollers 90*a* are disposed on the downstream side of the upstream side rollers 40*a* in the conveying direction. The downstream side rollers 90*a* idle if rotation force in the conveying direction acts thereon from the paper S. The bending portion 80 is disposed between the upstream side rollers 40*a* and the downstream side rollers 90*a* in the conveying direction. The bending portion 80 holds the paper S to be bent. The control unit 37 controls a conveying speed of the paper S of the upstream side rollers 40*a*. Consequently, excessive tensile stress does not act on the paper S, and thus the paper jam due to damage of the paper S can be prevented.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A paper feeding device comprising:

a paper roll holder;

a first roller that is rotated to convey paper drawn out from the paper roll;

a bending portion having a curved inner guide and a curved outer guide between which the paper conveyed by the first roller is conveyed;

a second roller that is disposed downstream of the bending portion in a conveying direction of the paper, and configured to be rotated to convey the paper conveyed from the bending portion;

a control unit configured to control rotation of the first roller so that the first roller conveys the paper at a target conveying speed;

a motor configured to drive the second roller; and a one-way clutch configured to connect the motor to the second roller when a pulling force in the conveying direction is not applied to the paper and to disconnect the motor from the second roller when the pulling force in the conveying direction is applied to the paper.

2. The device according to claim 1, further comprising:

a sensor configured to measure a bending amount of the paper in the bending portion, wherein, if the control unit detects that the bending amount of the paper measured by the sensor is less than a first predetermined value, the control unit increases the target conveying speed, and wherein, if the control unit detects that the bending amount of the paper measured by the sensor is more than a second predetermined value, the control unit reduces the target conveying speed.

3. The device according to claim 2, wherein the sensor is an optical sensor configured to measure the bending amount of the paper based on a travel distance of light emitted from the optical sensor to the paper and reflected from the paper and returned to the optical sensor.

4. The device according to claim 2, wherein the sensor includes an inner sensor having a first arm that is positioned between the inner guide and the outer guide so that the first arm is deflected by the paper when the bending amount of the paper is less than the first predetermined value, and an outer sensor having a second arm positioned between the inner guide and the outer guide so that the second arm is deflected by the paper when the bending amount of the paper is greater than the second predetermined value.

5. A paper feeding device of an image forming apparatus comprising:

a paper roll holder;

a first roller that is rotated to convey paper drawn out from the paper roll;

a bending portion having a curved inner guide and a curved outer guide between which the paper conveyed by the first roller is conveyed;

a second roller that is disposed downstream of the bending portion in a conveying direction of the paper, and configured to be rotated to convey the paper conveyed from the bending portion;

a cutting portion in a paper conveying path between the paper roll holder and the bending portion, the cutting portion configured to cut the paper when the image forming apparatus is operating in a cut paper feeding mode;

a control unit configured to control rotation of the first roller so that the first roller conveys the paper at a target conveying speed when the image forming apparatus is operating in a continuous paper feeding mode;

a motor configured to drive the second roller; and a one-way clutch configured to connect the motor to the second roller when a pulling force in the conveying direction is not applied to the paper and to disconnect the motor from the second roller when the pulling force in the conveying direction is applied to the paper.

6. The device according to claim 5, further comprising:

a sensor configured to measure a bending amount of the paper in the bending portion, wherein, if the control unit detects that the bending amount of the paper measured by the sensor is less than a first predetermined value, the control unit increases the target conveying speed, and wherein, if the control unit detects that the bending amount of the paper measured by the sensor is more than a second predetermined value, the control unit reduces the target conveying speed.

7. The device according to claim 6, wherein the sensor is an optical sensor configured to measure the bending amount of the paper based on a travel distance of light emitted from the optical sensor to the paper and reflected from the paper and returned to the optical sensor.

8. The device according to claim 6, wherein the sensor includes an inner sensor having a first arm that is positioned between the inner guide and the outer guide so that the first arm is deflected by the paper when the bending amount of the paper is less than the first predetermined value, and an outer sensor having a second arm positioned between the inner guide and the outer guide so that the second arm is deflected by the paper when the bending amount of the paper is greater than the second predetermined value.

9. A method of feeding paper to an image forming section of an image forming apparatus from a paper roll, said method comprising:

driving a first roller to rotate to draw the paper out from the paper roll and convey the paper;

driving a second roller to rotate to convey the paper conveyed by the first roller between a curved inner guide and a curved outer guide to the image forming section; and controlling the driving of the first roller so that the first roller conveys the paper at a target conveying speed, wherein the second roller is driven by a motor through a one-way clutch configured to connect the motor to the second roller when a pulling force in the conveying direction is not applied to the paper and to disconnect the motor from the second roller when the pulling force in the conveying direction is applied to the paper.

10. The method according to claim 9, further comprising:

measuring a bending amount of the paper when the paper is being conveyed between the inner guide and the outer guide, wherein if the bending amount of the paper is less than a first predetermined value, the target conveying speed is increased, and if the bending amount of the paper is more than a second predetermined value, the target conveying speed is decreased.

11. The method according to claim 10, wherein the measuring is performed by an optical sensor configured to measure the bending amount of the paper based on a travel distance of light emitted from the optical sensor to the paper and reflected from the paper and returned to the optical sensor.

12. The method according to claim 10, wherein the measuring is performed by an inner sensor having a first arm that is positioned between the inner guide and the outer guide so that the first arm is deflected by the paper when the bending amount of the paper is less than the first predetermined value, and an outer sensor having a second arm positioned between the inner guide and the outer guide so that the second arm is deflected by the paper when the bending amount of the paper is greater than the second predetermined value.

* * * * *